US006447304B1

(12) United States Patent
Korsunsky et al.

(10) Patent No.: US 6,447,304 B1
(45) Date of Patent: Sep. 10, 2002

(54) ELECTRICAL CONNECTOR

(75) Inventors: Iosif Korsunsky, Harrisburg, PA (US); Sidney Lu, Santa Clara, CA (US); Caesar Chen, Fountain Valley, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/858,841

(22) Filed: May 15, 2001

(51) Int. Cl.[7] ..... H01R 12/22

(52) U.S. Cl. ..... 439/66; 439/108

(58) Field of Search ..... 439/66, 74, 91, 439/108

(56) References Cited

U.S. PATENT DOCUMENTS

| | | | | | |
|---|---|---|---|---|---|
| 5,244,396 | A | * | 9/1993 | Matsuoka | 439/72 |
| 5,324,305 | A | * | 6/1994 | Ahmad et al. | 439/66 |
| 5,791,912 | A | * | 8/1998 | Riechelmann et al. | 439/66 |
| 5,820,389 | A | * | 10/1998 | Hashiguchi | 439/66 |
| 5,899,755 | A | * | 5/1999 | Kline | 439/66 |
| 6,083,022 | A | * | 7/2000 | Walkup | 439/260 |
| 6,176,707 | B1 | * | 1/2001 | Neidich et al. | 439/66 |

* cited by examiner

*Primary Examiner*—Gary F. Paumen
(74) *Attorney, Agent, or Firm*—Wei Te Chung

(57) ABSTRACT

An electrical connector comprises a housing having first and second surfaces and forming a plurality of contact supports formed therein. A plurality of electrical contacts is moveably attached to each corresponding support and has a first contacting end extending beyond the first surface for driving the contact to move along the support upon mating with an electrical device.

2 Claims, 7 Drawing Sheets

ELECTRICAL CONNECTOR

FIELD OF THE INVENTION

The present invention relates to an electrical connector, and more particularly to an electrical connector for electrically connecting two discrete electrical systems, such as two printed circuit boards and in which connecting ends of a contact perform robust wiping displacement over conductive pads formed on the printed circuit board thereby ensuring reliable electrical connection thereof.

DESCRIPTION OF THE PRIOR ART

Electrical connection between two terminals is generally facilitated by normal force exerted from one terminal to the other. However, since surface of the terminal could be contaminated by dust or oxidation, it is preferable to generate a wiping displacement between two terminals during mating. With the wiping displacement between the terminals, dust or oxidation on the terminal could be wiped out, thereby ensuring reliable electrical connection between two mated terminals.

U.S. Pat. No. 5,244,396 issued to Matsuoka on Sep. 13, 1993 discloses an arrangement for electrical connector in which contact 9 is obliquely arranged and which may provide a wiping displacement between contact 9 and element 4. However, Matsuoka's device is too complicated to implement.

In Matsuoka device, element 11 is insert molded within element 1, while contact 9 is moveably arranged within the element 11. The contact 9 includes a pair of arms 8 which can be deformed when the contact 9 is pushed downwardly by element 4. As stated above, the Matsuoka device is too complicated to be implemented in the socket connector for used with a CPU. (U.S. Pat. No. 6,083,022 discloses another oblique arrangement of the contacts in the connector housing.

U.S. Pat. No. 5,820,389 issued to Hashiguchi on Oct. 13, 1998, discloses an electrical connector to be used between a printed circuit board and a LSI (Large Scale Integration) circuit of the type which is disclosed in Japanese Utility Model Publication (B) No. 13191/1995 (hereinafter referred to as the '191 Publication). Since the '191 device can not provide enough wiping displacement between the contacting end and a corresponding conductive pad, Hashiguchi (the '389 patent) then provides an improvement on the arrangement of the contact such that a contact end thereof may perform an effective wiping displacement over a corresponding pad to ensure an effective electrical connection.

As shown in FIGS. 9A, 9B and 9C, the contact 20 is arranged in a passageway formed vertically in the housing 10. The contact 20 includes an extension 24 having a free end 24*b*. Theoretically, when contact end 23*a* is depressed by the element 200, contact end 24*b* will displace from its original position. It is understandable that Hashiguchi device is better than the '191 device as the extension 24 displace more than that of the '191 device. However, since the contact 20 is vertically arranged within the passageway, it is unlikely that the contact end 23*a* to perform a wiping displacement with respect to the corresponding element 200. Understandably, Hashiguchi solves only portion of the problem encountered by the '191.

On the other hand, even the extension 24 is arranged obliquely, the wiping displacement conducted by the contact end 24*b* is still not enough since before the contact end 24*b* is moved when the portion 23*a* is moved vertically down, there is a deformation incurred in portion 21*a*. Accordingly, Hashiguchi still leaves an opening for further improvement.

By the way, Hashiguchi does not meet the requirement since only the contact end 24*b* displaces a short distance over a conductive pad, while the contact end 23 does not displace when it is contacting with corresponding conductive pad.

SUMMARY OF THE INVENTION

It is an objective of this invention to provide an electrical connector in which a contact is moveably and obliquely arranged within a passageway of a housing thereof, thereby providing effective wiping displacement over corresponding conductive pads by both ends of the contact thereof.

In order to achieve the objective set forth, an electrical system in accordance with comprises a first electrical device including a first substrate having at least a first conductive pad formed thereon. A second electrical device includes a second substrate having at least a second conductive pad formed thereon. An electrical device is arranged between first and second electrical devices for electrically connecting the first and second conductive pads of the first and second electrical devices. The electrical device includes a housing defining at least a passageway extending between first and second surfaces. At least an electrical contact is moveably installed within the passageway which contacting ends extending beyond the surfaces, wherein upon connecting the first and second electrical devices, the electrical contact is moved by the first electrical device such that the contacting ends of the contact displace and wipe over the conductive pads of the electrical devices.

According to another embodiment of the present invention, an electrical connector in accordance with the present invention comprises a housing having first and second surfaces and forming at least a contact support therein. At least an electrical contact is moveably attached to the support and having a first contacting end extending beyond the first surface for driving the contact to move along the support upon mating with an electrical device.

DETAILED DESCRIPTION OF PREFERRED EMBODIMENTS

Figure 1:
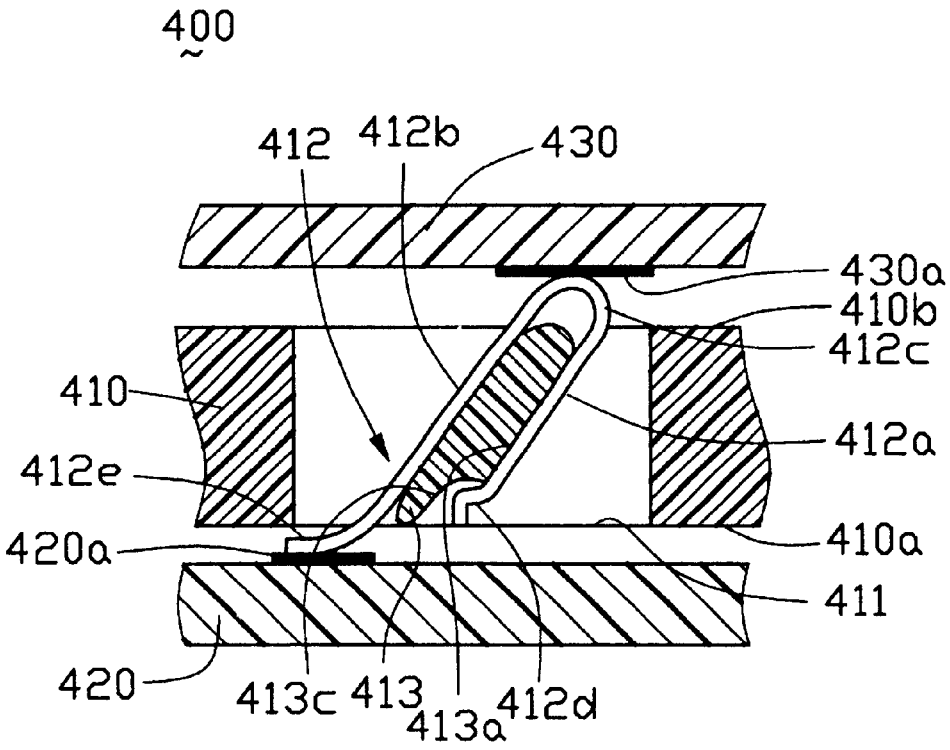
FIG. 1 is an illustration view showing an basic electrical system in according to the present invention.

Referring to FIGS. 1 to 4, an electrical connector 400 in accordance with the present invention includes a housing 410 defining at least a passageway 411 extending between first and second surfaces 410*a,* 410*b*. A contact support 413 is arranged within the passageway 411. An electrical contact 412 is moveably enveloped onto the support 413.

The electrical connector 400 is arranged between first and second substrates 420, 430. and according to the preferred embodiment, the first substrate 420 is a motherboard having at least a conductive pad 420*a* thereon, while the second substrate 430 is a CPU having a plurality of conductive pads 430*a* thereon.

The contact 412 includes an anchoring arm 412*a,* and a connecting arm 412*b* connected to the anchoring arm 412*a* by a bight portion 412*c*. The anchoring arm 412*a* is moveably against to a first side 413*a* of the support 413. The anchoring arm 412*a* further includes an anchoring leg 412*d* engaging with the shoulder 413*c* of the first side 413*a* of the support 413. Accordingly, when the contact 412 is enveloped onto the support 413, the arrangement between the shoulder 413*c* and the anchoring leg 412*d* can prevent the contact 412 from removing from the support 413.

The connecting arm 412*b* includes a contact end 412*e* for electrically contacting with the conductive pad 420*a* of the motherboard 420. The connecting arm 412*b* is generally longer than the anchoring arm 412*a* and the support 413 such that the bight portion 412*c* and the contacting end 412*d* extend beyond the first and second surfaces 410*a,* 410*b*. The bight portion 412*c* works as a contacting end in electrically contact with the conductive pad 430*a* of the CPU 430 or the equivalent.

Figure 2:
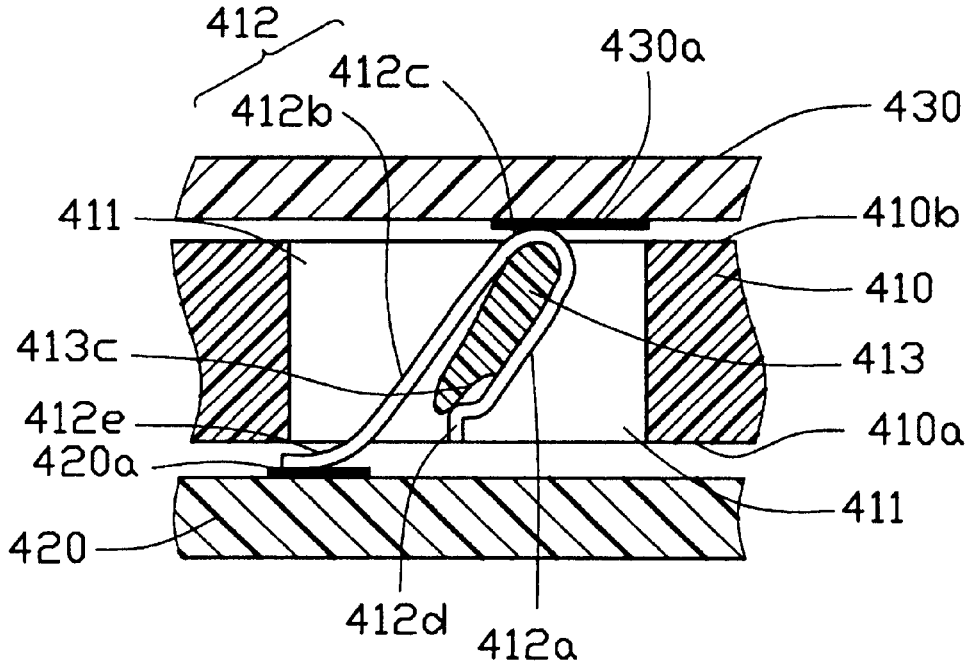
FIG. 2 is similar to FIG. 1 in which a contact is mated with conductive pads of upper and lower printed circuit boards.

Referring to FIG. 2, when the upper substrate 430 is moved downward, the bight portion 412*c* is driven downward such that the contact 412 is moved along the support 413. As a result, the contact end 412*e* of the connecting arm 412*b* extends along the conductive pad 420*a* of the first substrate 420 thereby facilitating reliable wiping movement for effective electrical connection. Meanwhile, the bight portion 412*c* is also wiping over the conductive pad 430 during its downward movement. Accordingly, reliable connections can be made on both the contact end 412*e* and the bight portion 412*c*.

Figure 3:
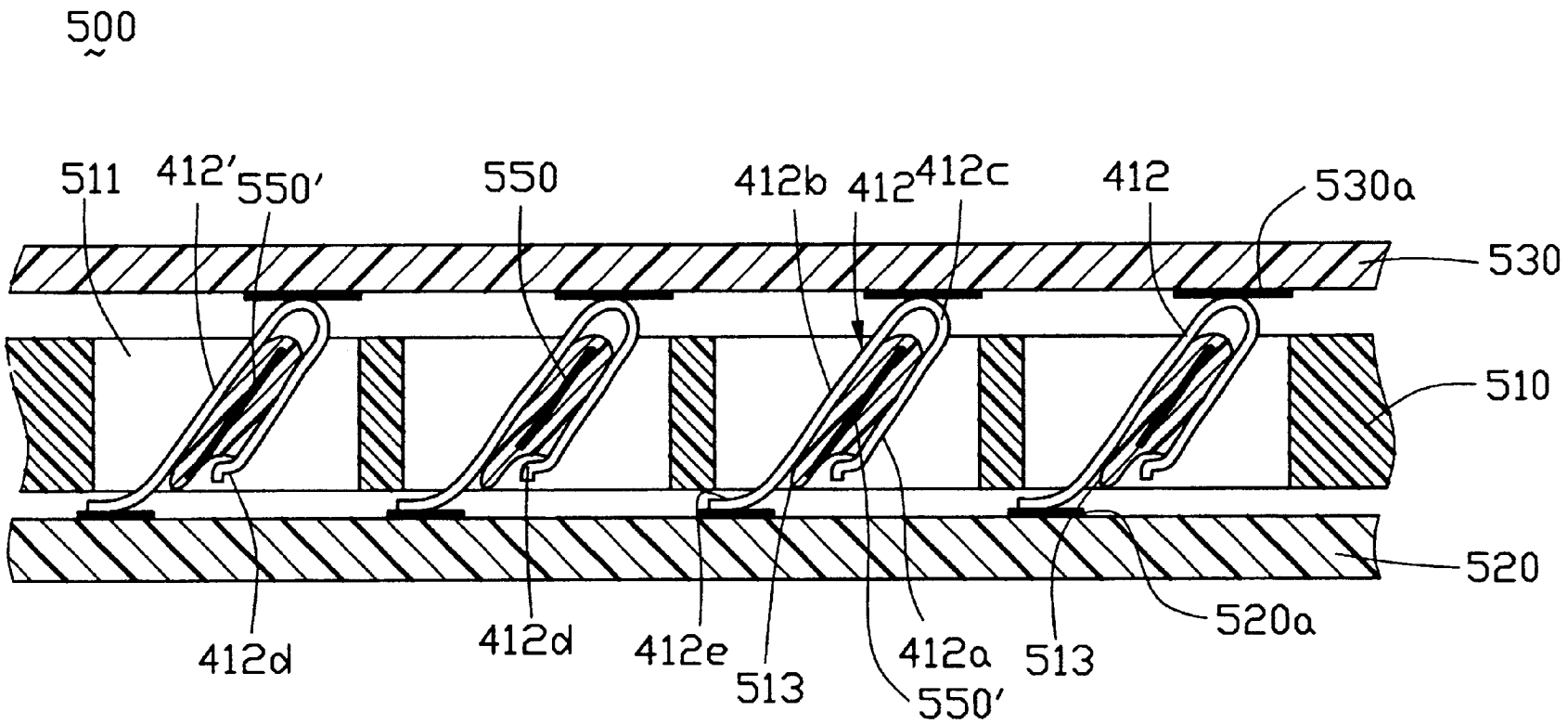
FIG. 3 is a cross sectional view of an electrical connector in accordance with a first embodiment of the present invention.

FIG. 3 is a sketch view showing a plurality of contact supports 513 is arranged within passageways 511 of a connector housing 510 of an electrical connector 500. The electrical connector 500 is between a first printed circuit board 520, and a second printed circuit board 530 or a CUP such as described in FIGS. 1 and 2. Each of the printed circuit boards 520, 530 is provided with conductive pads 520*a,* 530*a*. As it can be readily seen from FIG. 3, a grounding bus 550 is integrally formed within the contact supports 513. According to one of the embodiments, the grounding bus 550' is exposed for electrically connecting to anchoring tail 412*f* of the of the anchoring arm 412*a*. As a result, the selected contact 412' is grounded, while other contact 412 is not grounded.

Meanwhile, to the grounding bus 550 completely enclosed by the contact support 413, it serves as an electrical coupling to reduce noise and improve performance when the system is used for high speed signal transmission. As a result, the electrical mechanism disclosed here is perfectly suitable for high speed signal transmission.

Figure 4:
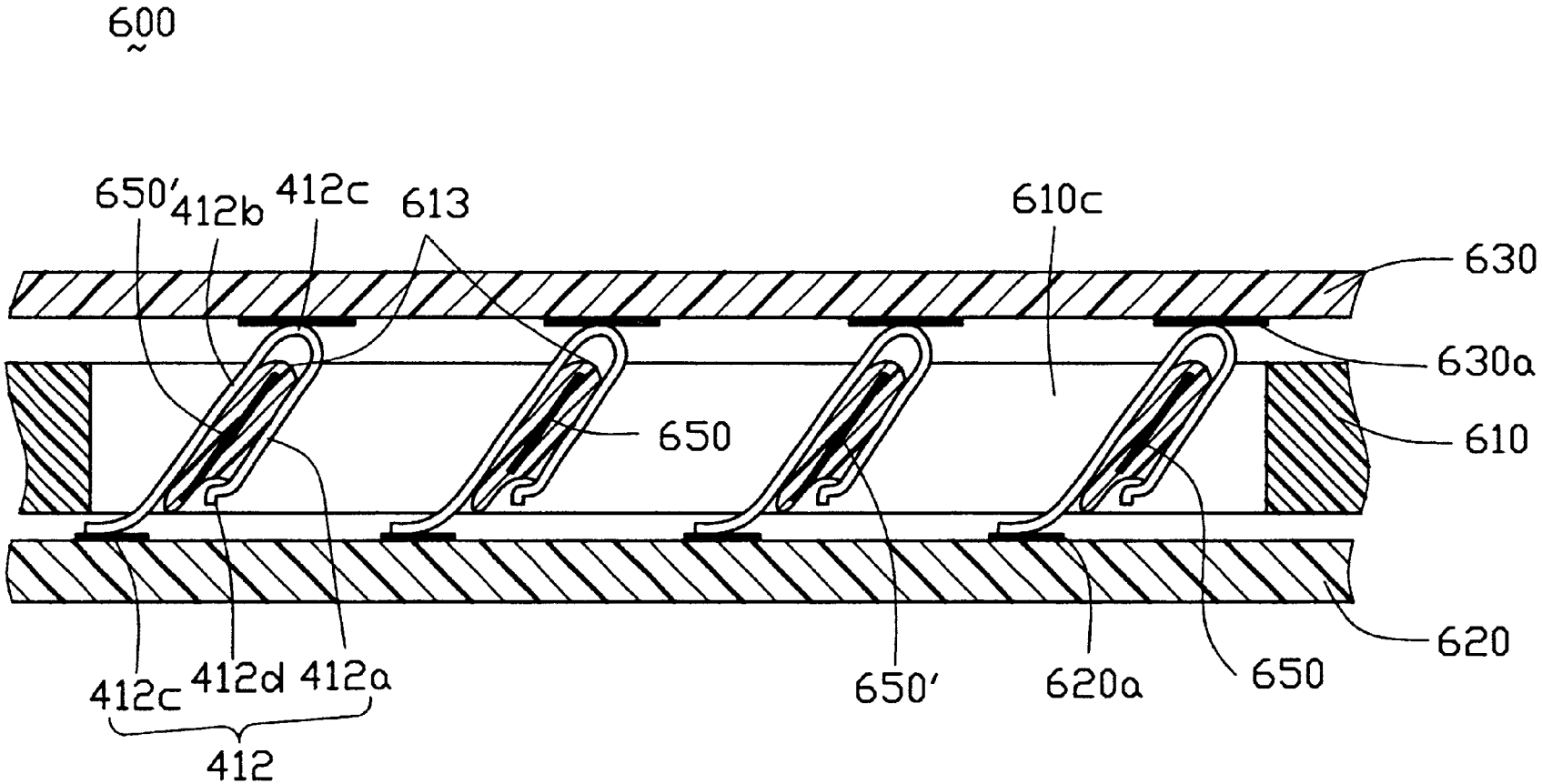
FIG. 4 is still a cross sectional view of an electrical connector in accordance with a second embodiment of the present invention.

FIG. 4 disclose a sketch showing a plurality of contact supports 613 arranged in a common cavity 610*c* of an electrical connector housing 610 of an electrical connector 600. The electrical connector 600 is between a first printed circuit board 620, and a second printed circuit board 630 or a CUP such as described in FIGS. 1 and 2. Each of the printed circuit boards 620, 630 is provided with conductive pads 620*a,* 630*a*. Since the passageways are omitted, the density of the contact supports 613 can be increased while without compromising the advantages of the mechanism disclosed in the present invention.

Similar to FIG. 3, grounding buses 550 are integrally formed within the contact supports 613 to providing electrical coupling to corresponding contact 412. According to one of the embodiment, some of the grounding bus 650' are exposed for electrically connecting to anchoring tail 412*f* of the of the anchoring arm 412*a*. As a result, the selected contact 412' is grounded, while other contact 412 is not grounded. This provides excellent noise shielding.

Figure 5A:
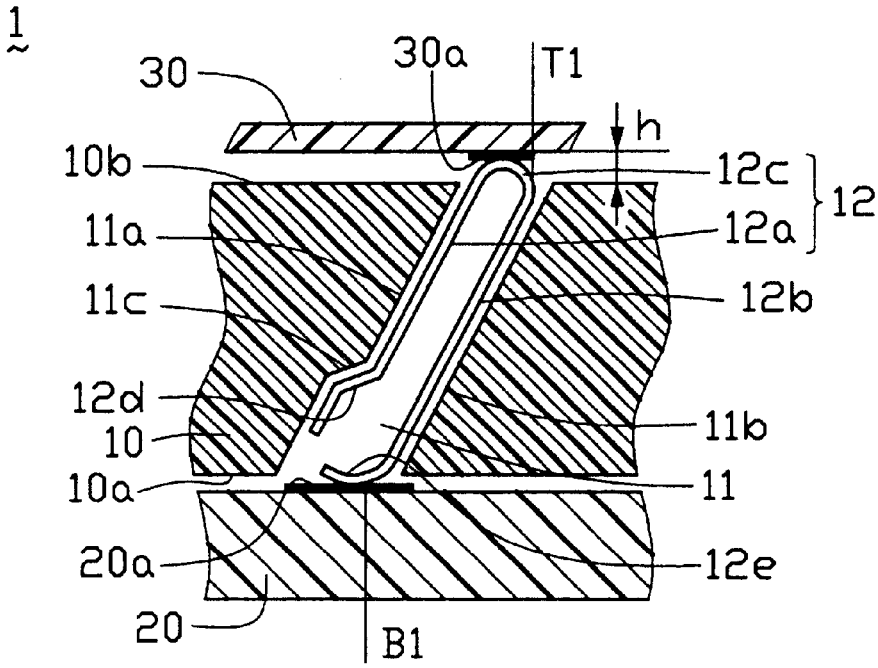
FIG. 5A is an illustration of a connector device in accordance with the present invention and arranged between two parallel substrates, a contact within a passageway of a housing is located in a first position.
Figure 5B:
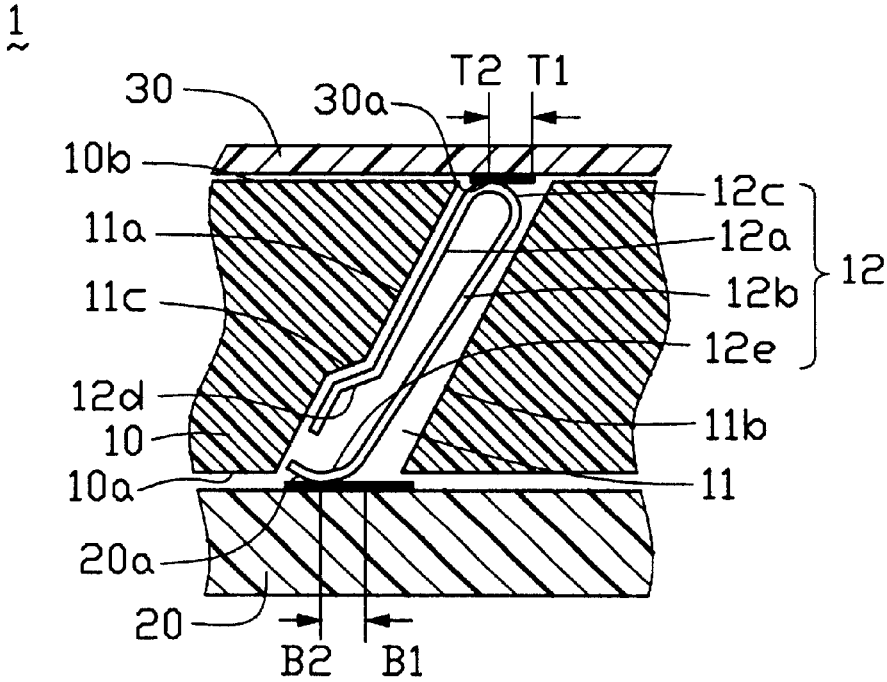
FIG. 5B is similar to FIG. 5A showing the contact is located in a second position.
Figure 6:
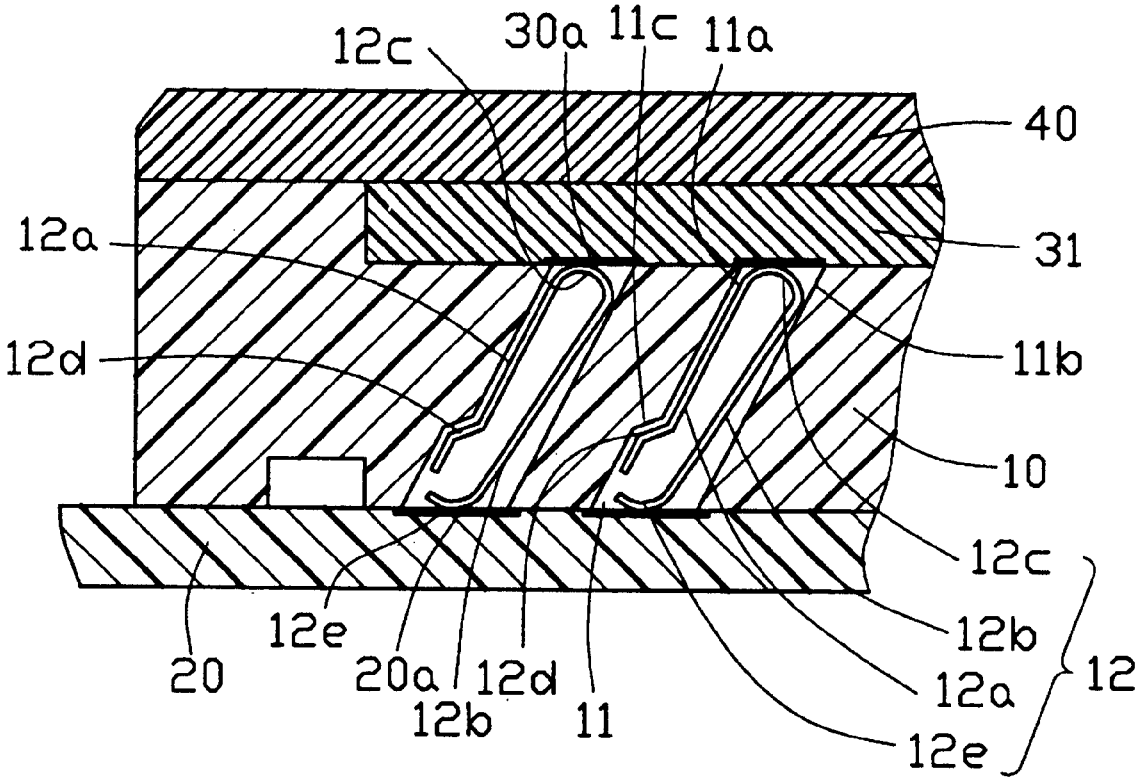
FIG. 6 is an illustration showing the connector device is used to interconnect a CPU and a motherboard.

Referring to FIGS. 5A, 5B and 6, an electrical connector device 1 in accordance with the present invention includes a housing 10 defining first and second surfaces 10*a,* 10*b* for respectively mounting on a first substrate 20, and supporting a second substrate 30. According to the preferred embodiment, the first substrate 20 is a motherboard having at least a conductive pad 20*a* thereof, while the second substrate 30 is a CPU 31 (see FIG. 6) having a plurality of conductive pads 30*a* thereon. For simplicity, only one conductive pad 30*a* is shown.

The housing 10 defines at least a passageway 11 arranged obliquely between first and second surfaces 10*a,* 10*b*. The passageway 11 includes a first side 11*a* having a shoulder 11*c* thereof, and a second side 11*b* which is a flush surface. In general, the first and second sides 11*a,* 11*b* are parallel to each other.

A contact 12 is moveably arranged into the passageway 11 and includes an anchoring arm 12*a,* and a connecting arm 12*b* connected to the anchoring arm 12*a* by a bight portion 12*c*. The anchoring arm 12*a* is moveably against to the first side 11*a*. The anchoring arm 12*a* further includes an anchoring leg 12*d* engaging with the shoulder 11*c* of the first side 11*a*. Accordingly, when the contact 12 is inserted into the passageway 11 from the second surface 10*b* to the first surface 10*a,* the arrangement between the shoulder 11*c* and the anchoring leg 12*d* can prevent the contact 12 from removing from the passageway 11.

The connecting arm 12*b* includes a contact end 12*e* for electrically contacting with the conductive pad 20*a* of the motherboard 20. The connecting arm 12*b* is generally longer than the anchoring arm 12*a* and the passageway 11 such that the bight portion 12*c* and the contacting end 12*d* extend beyond the first and second surfaces 10*a,* 10*b*. The bight portion 12*c* works as a contacting end in electrically contact with the conductive pad 30*a* of the CPU 30.

As shown in FIG. 5A, the length of the connecting arm 12*b* is arranged such that the bight portion 12*c* extend above the second surface 10*b* with a height (h). Before the CPU 30 is attached to the second surface 10*b* of the connector device 1, the bight portion 12*c* is located at a first position T1, while the contacting end 12*d* is located also at a first position B1. When the CPU 30 is attached to the second surface 10*b,* the connecting arm 12*b* is pushed downward by the bight portion 12*c* such that the contacting end 12*d* displaces and wipes from B1 to B2. On the other hand, during the downward movement of the bight portion 12*c,* the bight portion 12*c* displaces and wipes also from T1 to T2. Accordingly, both the contacting end 12*d* and the bight portion 12*c* displace and wipe over the conductive pad 20*a,* and 30*a* respectively. Accordingly, reliable connections between the contacting end 12*d* and the conductive pad 20*a* of the first substrate 20, and the bight portion 12*c* and the conductive pad 30*a* of the second substrate 30 are achieved.

The displacement of both the bight portion 12*c* and the contacting end 12*d* is achieved because both extend substantially beyond the first and second surfaces 10*a,* 10*b.* In addition, the second side 11*b* is an inclined surface, accordingly a vertical movement of the bight portion 12*c* can be effectively transferred to a horizontal movement, i.e. a wiping movement. In light of this, both the contacting end 12*d* and the bight portion 12*c* perform a considerable wiping displacement which benefits reliable and effective electrical connections.

FIG. 6 is an illustration showing the CPU 31 is electrically connected to the motherboard 20 by means of the connector device 1 in accordance with the present invention. The CPU 31 can be attached to the connector device 10 by means of a cover 40.

Figure 7A:
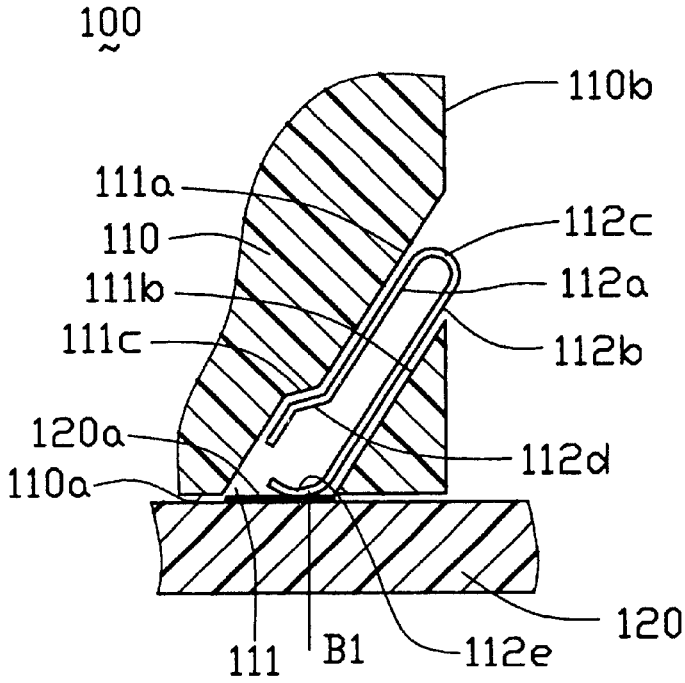
FIG. 7A is still an illustration of a second embodiment of a connecting device in accordance with the present invention and arranged between two substrates being orthogonal to each other, a contact within a passageway of a housing is located in a first position.
Figure 7B:
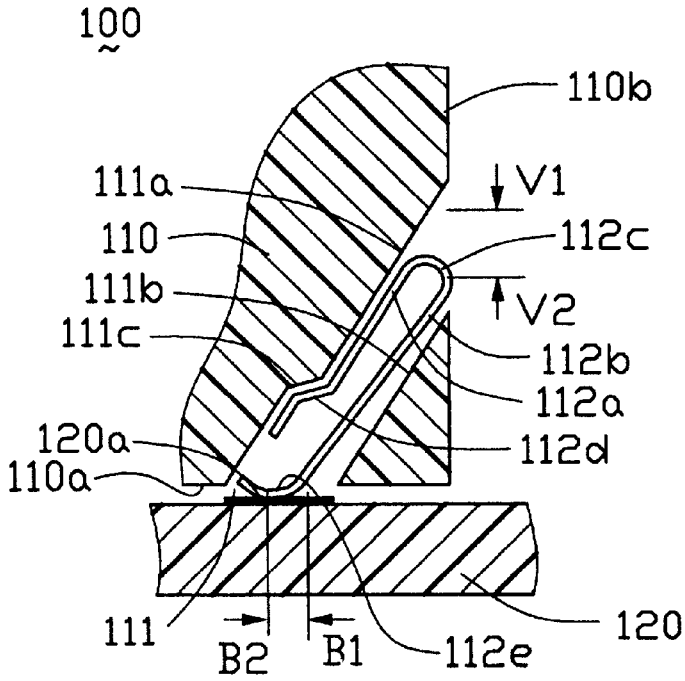
FIG. 7B is similar to FIG. 7A showing the contact is located in a second position.
Figure 8:
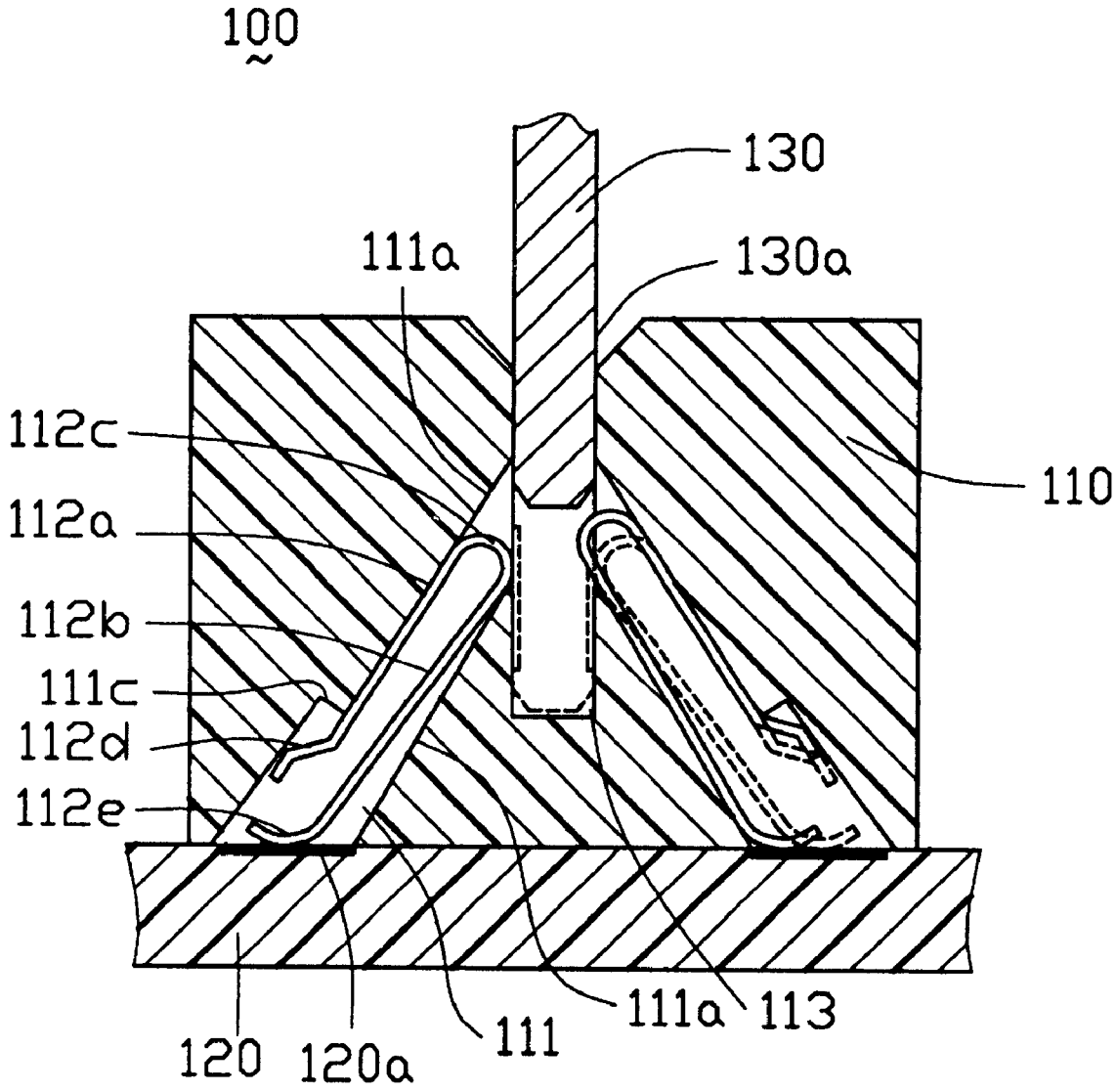
FIG. 8 is an illustration showing a second embodiment of the connector device is used as a card edge connector.

Referring to FIGS. 7A, 7B and 8, a connector device 100 in accordance with the present invention includes a housing 110 defining first and second surfaces 110*a,* 110*b* which are orthogonal to each other. A passageway 111 extends between first and second surfaces 110*a,* 110*b.* The passageway 111 includes a first side 111*a* having a shoulder 111*c* thereof, and a second side 111*b* which is a flush surface.

A contact 112 is moveably arranged into the passageway 111 and includes an anchoring arm 112*a,* and a connecting arm 112*b* connected to the anchoring arm 112*a* by a bight portion 112*c.* The anchoring arm 112*a* is moveably against to the first side 111*a.* The anchoring arm 112*a* further includes an anchoring leg 112*d* engaging with the shoulder 111*c* of the first side 111*a.* Accordingly, when the contact 112 is inserted into the passageway 111 from the second surface 110*b* to the first surface 110*a,* the arrangement between the shoulder 111*c* and the anchoring leg 112*d* can prevent the contact 112 from removing from the passageway 111.

The connecting arm 112*b* includes a contact end 112*e* for electrically contacting with the conductive pad 120*a* of the motherboard 120. The connecting arm 112*b* is generally longer than the anchoring arm 112*a* and the passageway 111 such that the bight portion 112*c* and the contacting end 112*d* extend beyond the first and second surfaces 110*a,* 110*b.* The bight portion 112*c* works as a contacting end in electrically contact with the conductive pad 130*a* of a daughter card 130.

As shown in FIG. 7A, the length of the connecting arm 112*b* is arranged such that the bight portion 112*c* extend above the second surface 110*b* with a distance. Before the daughter card 130 is attached to the second surface 110*b* of the connector device 100, the bight portion 112*c* is located at a first position V1, while the contacting end 112*d* is located also at a first position B1. When the daughter card 130 is attached to the second surface 110*b,* the connecting arm 112*b* is pushed downward by the bight portion 112*c* such that the contacting end 112*d* displaces and wipes from B1 to B2. On the other hand, during the downward movement of the bight portion 112*c,* the bight portion 112*c* displaces and wipes also from V1 to V2. Accordingly, both the contacting end 112*d* and the bight portion 112*c* displace and wipe over the conductive pad 120*a,* and 130*a* respectively. Accordingly, reliable connections between the contacting end 112*d* and the conductive pad 120*a* of the first substrate 120, and the bight portion 112*c* and the conductive pad 130*a* of the second substrate 130 are achieved.

The displacement of both the bight portion 112*c* and the contacting end 112*d* is achieved because both extend substantially beyond the first and second surfaces 110*a,* 110*b.* In addition, the second side 111*b* is an inclined surface, accordingly a vertical movement of the bight portion 112*c* can be effectively transferred to a horizontal movement, i.e. a wiping movement. In light of this, both the contacting end 112*d* and the bight portion 112*c* perform a considerable wiping displacement which benefits reliable and effective electrical connections.

FIG. 8 illustrates that the housing 110 includes a pair of passageways 111 symmetrically arranged thereof. A receiving slot 113 is defined in the housing 110 and in communication with the passageways 111. By this arrangement, the bight portions 112*c* of the contact 112 extend into the receiving slot 113. When the daughter card 130 is inserted into the receiving slot 113, the contacts 112 are pushed downward such that the contacting ends 112*d* displace and wipe over the conductive pads 120*a* of the motherboard 120. On the other hand, the bight portions 112*c* displace and wipe over the conductive pads 130*a* of the daughter card 130. Accordingly, reliable and effective electrical connections are achieved on both the bight portions 112*c* and the contacting ends 112*d.*

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claims:

1. An electrical system, comprising a first electrical device including a first substrate having at least a first conductive pad formed thereon;

a second electrical device including a second substrate having at least a second conductive pad formed thereon;

an electrical device arranged between first and second electrical devices for electrically connecting said first and second conductive pads, said electrical device including a housing defining at least a passageway extending between first and second surfaces and a contact support arranged within said passageway, at least an electrical contact moveably attached to said support having contacting ends extending beyond said surfaces, wherein upon connecting said first and second electrical devices, said electrical contact being moved by said first electrical device such that said contacting ends of said contact displace and wipe over said conductive pads of said electrical devices;

wherein said passageway is obliquely arranged between said first and second surfaces;

wherein said contact support is obliquely arranged within said passageway;

wherein said contact support is arranged in said passageway such that said contact is arranged in parallel to said passageway;

wherein interengaging means are arranged between said contact support and said contact such that said contact will not escape from said contact support;

wherein said interengaging means includes a recess defined in said contact support and an anchoring tail of said contact extending into said recess.

2. An electrical connector, comprising:

a housing having first and second surfaces and forming a plurality of contact supports therein; and a plurality of ground buses integrally formed within said contact supports; and a plurality of electrical contacts moveably attached to said supports and having first contacting ends extending beyond said first surface for driving said contacts to move along said supports upon mating with an electrical device;

wherein interengaging means are arranged between each said contact support and said corresponding contact such that said contact will not escape from said contact support;

wherein said interengaging means includes a recess defined in said contact support and an anchoring tail extending into said recess;

wherein at least one of said recesses defined in said contact supports is deep enough to expose said ground bus such that said anchoring tail contacts said exposed ground bus;

wherein said contacts include second contact ends extending beyond said second surface.

* * * * *